US006326890B1

(12) United States Patent
Costa

(10) Patent No.: US 6,326,890 B1
(45) Date of Patent: Dec. 4, 2001

(54) ANTI-THEFT DEVICE FOR ITEMS HAVING PORTIONS WHICH CAN BE SURROUNDED BY STRAPS OR THE LIKE

(76) Inventor: Emilio Costa, Viale Trento 81/B, 36078 Valdagno (IT)

( * ) Notice: Subject to any disclaimer, the term of this patent is extended or adjusted under 35 U.S.C. 154(b) by 0 days.

(21) Appl. No.: 09/629,486

(22) Filed: Jul. 31, 2000

(30) Foreign Application Priority Data

Aug. 6, 1999 (IT) ..... PD99A0191

(51) Int. Cl.[7] ..... G08B 13/14

(52) U.S. Cl. ..... 340/572.9; 340/572.1; 340/571; 340/572.8; 340/568.1

(58) Field of Search ..... 340/572.1, 572.9, 340/572.8, 571, 568.1

(56) References Cited

U.S. PATENT DOCUMENTS 3,874,034 * 4/1975 Clayton ..... 24/30.5 P
5,524,463 * 6/1996 Schenkel et al. ..... 340/572
5,883,576 * 3/1999 De La Huerga ..... 340/572.8
5,969,613 * 10/1999 Yeager et al. ..... 340/572.9
6,044,669 * 4/2000 Levi ..... 70/18

* cited by examiner

*Primary Examiner*—Jeffery Hofsass
*Assistant Examiner*—Hung Nguyen
(74) *Attorney, Agent, or Firm*—Guido Modiano; Albert Josif; Daniel O'Byrne

(57) ABSTRACT

An anti-theft device for objects provided with portions which can be surrounded by straps or the like. The anti-theft device comprises a strap, an enclosure which contains an excitable signaling component and an engagement elements in which it is possible to insert and lock a first end of the strap, the engagement means being rigidly coupled to, and adjacent to, the enclosure together with a coupling element for the mating of a second end of the strap, which is closed like a noose onto the element to be protected against theft.

22 Claims, 4 Drawing Sheets

ANTI-THEFT DEVICE FOR ITEMS HAVING PORTIONS WHICH CAN BE SURROUNDED BY STRAPS OR THE LIKE

BACKGROUND OF THE INVENTION

The present invention relates to an anti-theft device for objects having portions which can be surrounded by straps or the like.

It is known that anti-theft devices provided with a component which is adapted to be detected if it is immersed in an electromagnetic field normally generated in the presence of a guided exit of the shop or business concern in which the anti-theft devices are adopted, are currently increasingly widespread.

These devices are rigidly coupled to the object to be protected against theft and are separated from it by breaking or by removal by means of special tools, normally when the object is regularly purchased and before the purchaser leaves the shop.

Such devices are generally characterized in that they comprise a strap which is adapted to close like a noose on an application portion of the object to be protected against theft.

The strap is provided with a container for a device which is excitable and therefore detectable in the presence of electromagnetic fields: the strap extends with two portions from the container of the excitable device, namely a rack-shaped first portion with teeth having a triangular cross-section and a second portion which instead supports an anti-theft device composed of a box-like expanded region which is provided with a through hole and accommodates an elastic tab which is shaped complementarily to the rack of the first portion.

Once the first portion of the strap is inserted into the second one, the rack-like portion irreversibly engages the tab, stably fixing the container that accommodates the excitable device to the object of application.

These devices have drawbacks, including limited versatility.

The length of the portion of the strap that supports the box-like expanded region with a through hole in fact determines the minimum perimeter of the portion of the object to be coupled.

The length of the rack-like portion instead determines the maximum perimeter.

Moreover, in the internal part of the strap there are protrusions or studs which do ensure the locking of the device in some cases but hinder its use in others, because they stiffen the strap.

Still further, in some applications the device moves, making it difficult to use for demonstration purposes the product to which the device is connected.

SUMMARY OF THE INVENTION

The aim of the present invention is to eliminate the drawbacks of conventional anti-theft devices by providing a device which has a more versatile use and can be disconnected from the object of application without having to break it.

Another object of the invention is to provide a device which is compact and which, once applied to an object, does not alter its aesthetic appearance or prevent its use for demonstration before sale.

Another object of the invention is to obtain a device which allows to use the object of application for demonstration before sale without the device moving and being an annoyance for the user.

Another object of the invention is to provide a device which can be marketed at competitive prices.

These and other objects which will become better apparent hereinafter are achieved by an anti-theft device for objects provided with surroundable portions which comprises a strap, an enclosure which contains an excitable signaling component and an engagement means in which it is possible to insert and lock a first end of the strap, characterized in that said engagement means is rigidly coupled to, and adjacent to, said enclosure together with a coupling element for the mating of a second end of the strap, which is closed like a noose onto the element to be protected against theft.

BRIEF DESCRIPTION OF THE DRAWINGS

Further characteristics and advantages of the present invention will become better apparent from the following detailed description of a preferred but not exclusive embodiment of the device, illustrated only by way of non-limitative example in the accompanying drawings, wherein.

DESCRIPTION OF THE PREFERRED EMBODIMENTS

Figure 3:
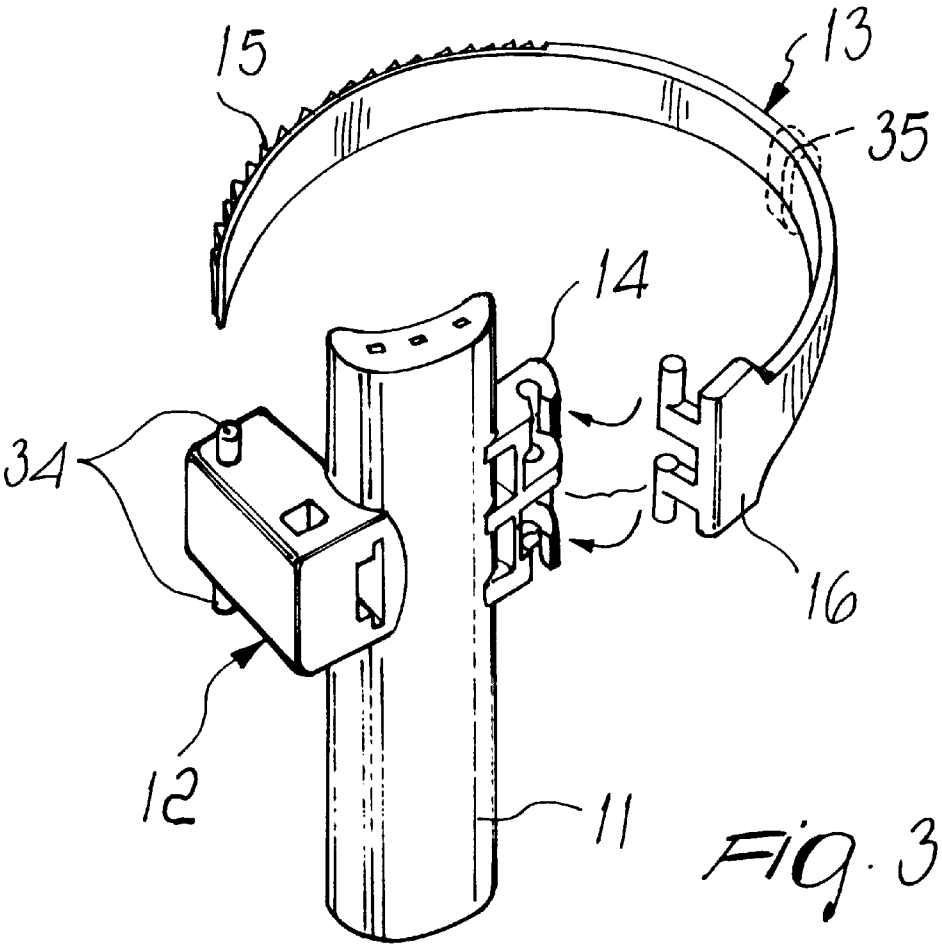
FIG. 3 is a perspective view of the device with the strap uncoupled.
Figure 1:
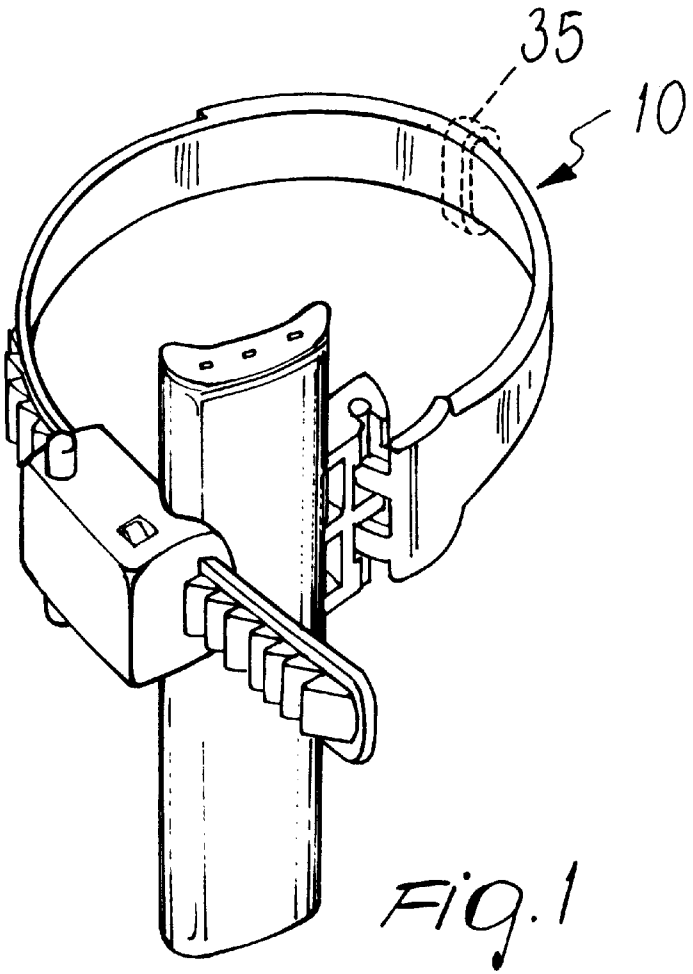
FIG. 1 is a perspective view of a device according to the invention in a closed condition.
Figure 2A:
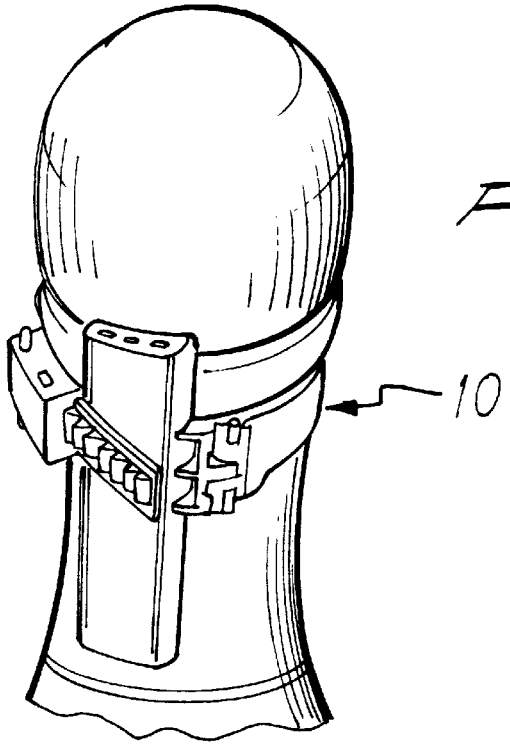
FIGS. 2*a* and 2*b* are perspective partial views of the device of FIG. 1 respectively in an example of application to the neck of a bottle and on the handle of a tennis racket.
Figure 2B:
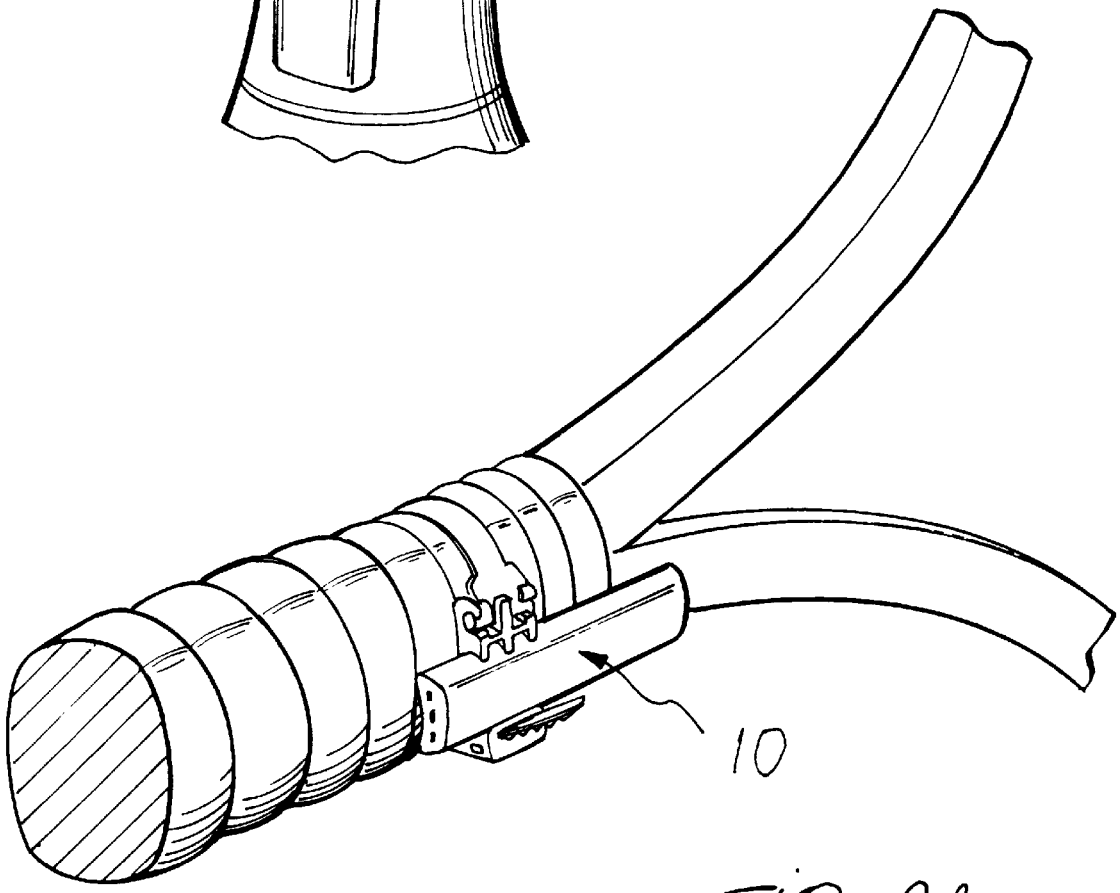
Figure 4:
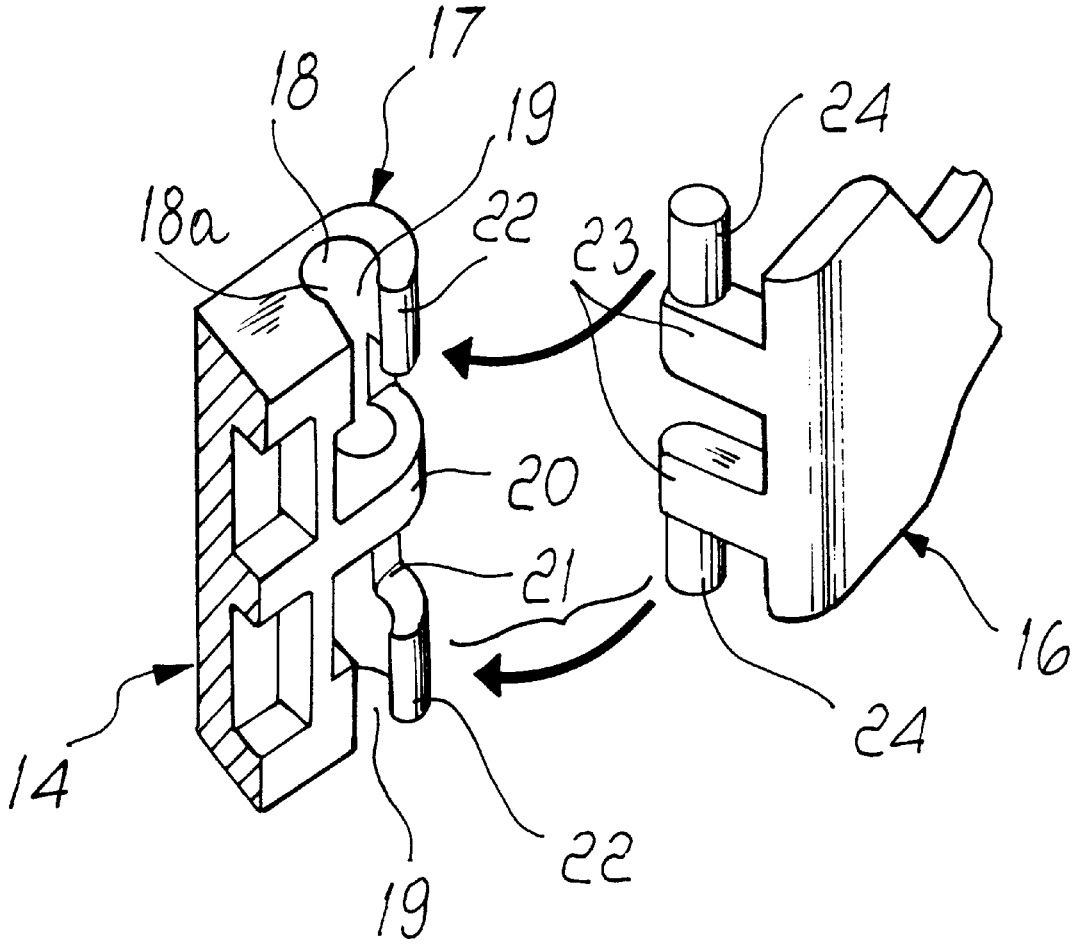
FIG. 4 is a perspective view of the coupling element and of the end of the strap that mates with it.
Figure 5:
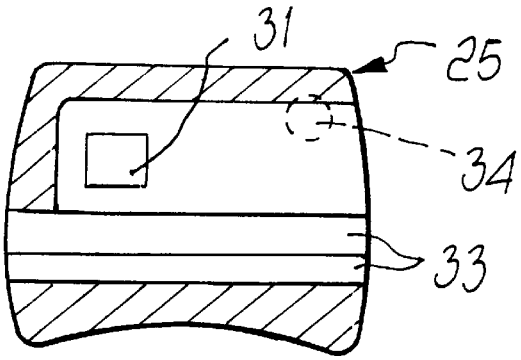
FIG. 5 is a sectional plan view of the container that constitutes the engagement device.
Figure 6:
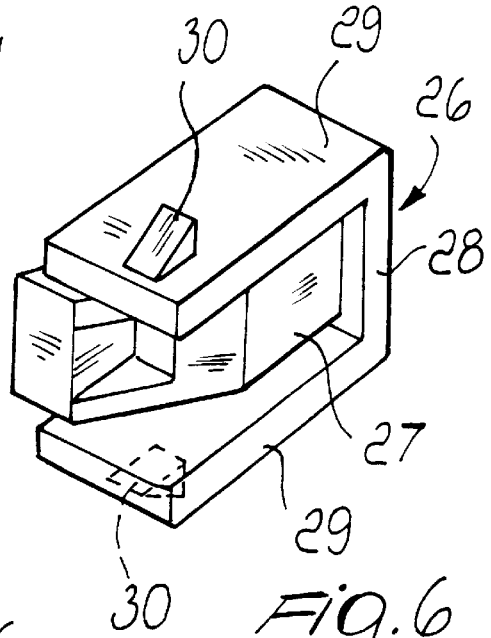
FIG. 6 is a perspective view of the component provided with a toothed tab of the engagement device.
Figure 8:
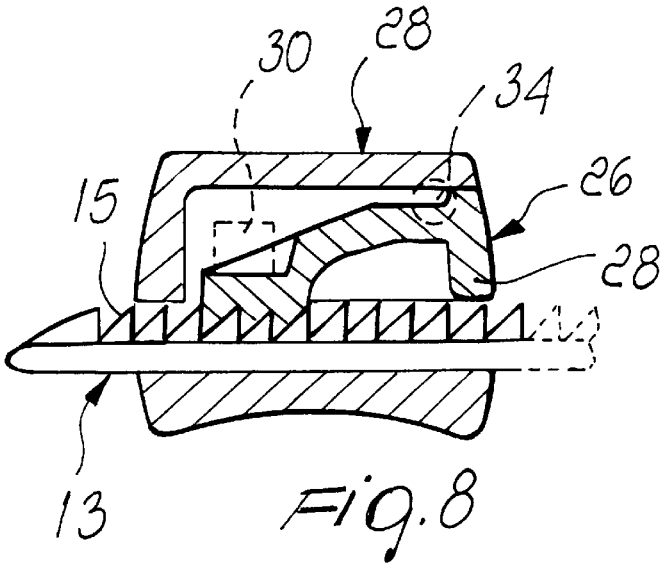
FIG. 8 is a sectional plan view of the engagement device, shown assembled and with the toothed end of the strap inserted.
Figure 7:
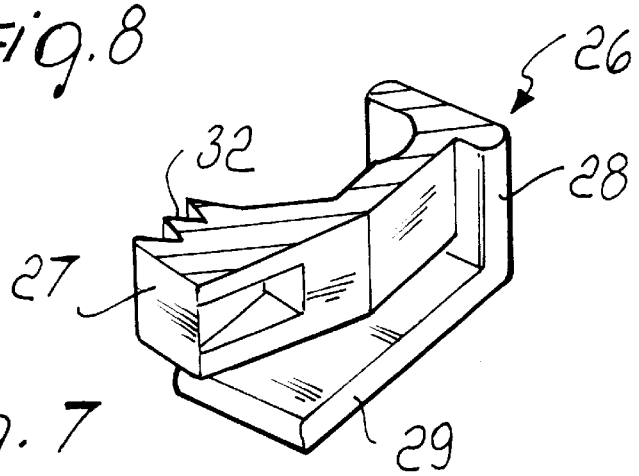
FIG. 7 is a perspective view of the same component as in FIG. 5, but shown in cross-section.

With reference to FIGS. 1 to 8, an anti-theft device for objects having surroundable portions, according to the invention, is generally designated by the reference numeral 10 and comprises an enclosure 11 which contains an excitable signaling device which is not shown in the figure, a coupling element 14 for the mating of a strap 13, and an engagement means 12, which constitute a single part.

The strap 13 has two separate ends: a first end 15 for insertion in the engagement means 12 is rack-shaped, with teeth having a triangular cross-section, while a second other end, designated by the reference numeral 16, is shaped so as to mate with the coupling element 14 so as to be rotatably coupled thereto.

The coupling element 14 is substantially shaped like a parallelepiped with a portion 17 provided with rounded edges.

Portion 17 has a through hole 18 and a radial opening 19 which affects the entire length of the element 14 at the hole 18 except for a small central region 20.

The radial opening 19 is wider at the two regions 21 that are adjacent to the central region 20, thus forming at the end of the portion 17 two elastically flexible wings 22.

The particular geometry of the portion 17 of the coupling element 14 forms a seat 18*a* for two lugs 23 of the end 16 of the strap 13.

The two lugs 23 in fact have two identical cylindrical ends 24, which are coaxial and mutually opposite, lie at right angles to the main direction of the lugs 23, and have a diameter which is larger than the width of the radial openings 19, so that they are perfectly seated within the hole 18 by forcing the wings 22.

Such mating is provided so that uncoupling is not allowed in any way if the device 10 is applied to an object and is in any case allowed only if traction at right angles to a hypothetical surface of application is applied.

The openings 19 are in fact arranged at right angles to the direction of traction of the strap 13 when applied.

If the device 10 is not applied to an object, the strap 13 is capable of rotating by way of the greater radial gap of the two regions 21 that are adjacent to the central region 20 which allows the movement of the lugs 23.

The device 10 is fastened by inserting the rack-like part 15 of the strap 13 in the engagement means 12.

The engagement means 12 are constituted by a box-like body 25 and a component 26 which can be inserted therein and is provided with a central elastic tab 27 which is monolithic with respect to a base 28 provided with mutually opposite parallel elastic wings 29, each of which has, at its end, an engagement tooth 30 which is directed outward and is to be stably inserted upon assembly in a corresponding through hole 31 formed in a corresponding wall of the box-like body 25; the plane of the tab 27 being orientated at right angles to the plane of the wings 29.

The component 26 further has, at the tab 27, a rack-like portion 32 with teeth having a triangular cross-section, which is adapted to mate with the corresponding rack-like portion of the end 15 of the strap 13.

Moreover, the box-like body 25 has an internal surface which is shaped so as to form two mutually opposite slots 33 for the guided insertion of the strap 13.

Release of the strap 13 is possible only by using dedicated pliers, not shown in the figure.

The pliers have to be correctly positioned by means of the pins 34 and, by means of jaws, and act simultaneously on both teeth 30, disengaging them from the holes 31 by inward flexing of the wings 29, allowing to extract the component 26 with the toothed tab and therefore also extract the strap.

Moreover, at least one rubber sleeve 35 is used; the sleeve is threaded by the strap 13 and is very useful, since it allows excellent locking of the anti-theft device.

In practice, when an object is to be protected against theft with this device 10, the strap 13 that is most suitable according to the type of object is selected; the strap is rigidly coupled, with its non-toothed end 16, to the element 14, and after surrounding the surface of application the rack-like part 15 of the strap 13 is inserted in the engagement means 12, tightening the strap 13 as much as possible, without forgetting to optionally interpose between the strap 13 and the object sleeves 35 made of rubber or the like which are advantageously threaded by the strap and immobilize the anti-theft device.

It has been observed that the present invention has achieved the intended aim and objects.

Its most evident particularity is the possibility to apply the anti-theft device to several different objects simply by changing the strap, which can have the most disparate dimensions.

Attention is drawn to the structural simplicity of the device according to the invention, which can be effectively mass-produced and marketed at particularly competitive prices.

It should also be noted that the device according to the invention, owing to its reduced overall dimensions, does not penalize in any way the buyer's possibility to evaluate the object to which it is applied, and to handle it without said device moving.

The present invention is susceptible of modifications and variations, all of which are within the scope of the inventive concept.

The constructive details can be replaced with other technically equivalent elements.

The materials and the dimensions may be any according to requirements.

The disclosures in Italian Patent Application No. PD99A000191 from which this application claims priority are incorporated herein by reference.

What is claimed is:

1. An anti-theft device for objects provided with surroundable portions which comprises a strap, an enclosure which contains an excitable signaling component and an engagement means in which it is possible to insert and lock a first end of the strap, wherein said engagement means is rigidly coupled to, and adjacent to, said enclosure together with a coupling element for the mating of a second end of the strap, which is closed like a noose onto an element to be protected against theft, said engagement element and said coupling element being connected one opposite to another with respect to said enclosure, so that said strap adheres at any portion thereof to said element to be protected against theft.

2. The anti-theft device according to claim 1, wherein said first end of the strap is rack-shaped with teeth having a triangular cross-section, and said second end has two lugs having identical cylindrical ends which are coaxial and mutually opposite and protrude at right angles to the main direction of said lugs.

3. The anti-theft device according to claim 1, wherein said coupling element constitutes a hinge with the second end of the strap.

4. The anti-theft device according to claim 1, wherein said coupling element is substantially shaped like a parallelepiped with a portion having rounded edges and a through hole with a radial opening which affects the entire length of said hole except for a central region, in whose adjacent regions said radial opening is wider, leaving at the ends of said portion two flexible wings.

5. The coupling element according to claim 4, wherein said radial opening is arranged substantially at right angles to a direction of traction of said strap when installed.

6. The anti-theft device according to claim 1, wherein said engagement means is constituted by a box-like body and a by component which can be inserted therein and is provided with a central elastic tab which is monolithic with respect to a base provided with parallel and mutually opposite elastic wings, each wing having, at an end thereof, an engagement tooth which is directed outward and is to be stably inserted, upon assembly, in a corresponding through hole formed in a corresponding wall of the box-like body, a plane containing said tab being perpendicular to a plane containing said wings.

7. The engagement means according to claim 6, wherein said elastic tab is shaped complementarily to said first end of the strap.

8. The anti-theft device according to claim 1, further comprising rubber sleeves designed to wrap around the strap.

9. An anti-theft device for objects provided with surroundable portions which comprises a strap, an enclosure which contains an excitable signaling component and an engagement means in which it is possible to insert and lock a first end of the strap, wherein said engagement means is rigidly coupled to, and adjacent to, said enclosure together with a coupling element for the mating of a second end of the strap, which is closed like a noose onto an element to be protected against theft, and wherein said first end of the strap is rack-shaped with teeth having a triangular cross-section, and said second end has two lugs having identical cylindrical ends which are coaxial and mutually opposite and protrude at right angles to the main direction of said lugs.

10. The anti-theft device according to claim 9, wherein said coupling element constitutes a hinge with the second end of the strap.

11. The anti-theft device according to claim 9, wherein said coupling element is substantially shaped like a parallelepiped with a portion having rounded edges and a through hole with a radial opening which affects the entire length of said hole except for a central region, in whose adjacent regions said radial opening is wider, leaving at the ends of said portion two flexible wings.

12. The coupling element according to claim 11, wherein said radial opening is arranged substantially at right angles to a direction of traction of said strap when installed.

13. The anti-theft device according to claim 9, wherein said engagement means is constituted by a box-like body and a by component which can be inserted therein and is provided with a central elastic tab which is monolithic with respect to a base provided with parallel and mutually opposite elastic wings, each wing having, at an end thereof, an engagement tooth which is directed outward and is to be stably inserted, upon assembly, in a corresponding through hole formed in a corresponding wall of the box-like body, a plane containing said tab being perpendicular to a plane containing said wings.

14. The engagement means according to claim 13, wherein said elastic tab is shaped complementarily to said first end of the strap.

15. The anti-theft device according to claim 9, further comprising rubber sleeves designed to wrap around the strap.

16. An anti-theft device for objects provided with surroundable portions which comprises a strap, an enclosure which contains an excitable signaling component and an engagement means in which it is possible to insert and lock a first end of the strap, wherein said engagement means is rigidly coupled to, and adjacent to, said enclosure together with a coupling element for the mating of a second end of the strap, which is closed like a noose onto an element to be protected against theft, wherein said coupling element is substantially shaped like a parallelepiped with a portion having rounded edges and a through hole with a radial opening which affects the entire length of said hole except for a central region, in whose adjacent regions said radial opening is wider, leaving at the ends of said portion two flexible wings.

17. The anti-theft device according to claim 1, wherein said first end of the strap is rack-shaped with teeth having a triangular cross-section, and said second end has two lugs having identical cylindrical ends which are coaxial and mutually opposite and protrude at right angles to the main direction of said lugs.

18. The anti-theft device according to claim 16, wherein said coupling element constitutes a binge with the second end of the strap.

19. The coupling element according to claim 16, wherein said radial opening is arranged substantially at right angles to a direction of traction of said strap when installed.

20. The anti-theft device according to claim 16, wherein said engagement means is constituted by a box-like body and a by component which can be inserted therein and is provided with a central elastic tab which is monolithic with respect to a base provided with parallel and mutually opposite elastic wings, each wing having, at an end thereof, an engagement tooth which is directed outward and is to be stably inserted, upon assembly, in a corresponding through hole formed in a corresponding wall of the box-like body, a plane containing said tab being perpendicular to a plane containing said wings.

21. The engagement means according to claim 20, wherein said elastic tab is shaped complementarily to said first end of the strap.

22. The anti-theft device according to claim 16, further comprising rubber sleeves designed to wrap around the strap.

* * * * *